US007962978B2

(12) United States Patent
Chuang

(10) Patent No.: US 7,962,978 B2
(45) Date of Patent: Jun. 21, 2011

(54) COMFORTER SET

(76) Inventor: Henry Chuang, San Gabriel, CA (US)

( * ) Notice: Subject to any disclaimer, the term of this patent is extended or adjusted under 35 U.S.C. 154(b) by 164 days.

(21) Appl. No.: 11/479,425

(22) Filed: Jun. 29, 2006

(65) Prior Publication Data

US 2008/0016619 A1 Jan. 24, 2008

(51) Int. Cl.
*A47G 9/00* (2006.01)
*A47C 31/10* (2006.01)

(52) U.S. Cl. ..... 5/502; 5/482

(58) Field of Classification Search ..... 5/482, 486, 5/488, 500, 502
See application file for complete search history.

(56) References Cited

U.S. PATENT DOCUMENTS

| | | | | |
|---|---|---|---|---|
| 917,403 | A * | 4/1909 | Benger | 5/413 R |
| 1,361,320 | A * | 12/1920 | Friedman | 2/236 |
| 1,378,207 | A * | 5/1921 | Awner | 2/312 |
| 1,424,724 | A * | 8/1922 | Heller | 2/229 |
| 2,856,615 | A * | 10/1958 | Cirocco | 5/500 |
| 4,384,380 | A * | 5/1983 | Glaha et al. | 5/485 |
| 4,573,227 | A * | 3/1986 | Prandina | 5/486 |
| 4,658,454 | A * | 4/1987 | Potter | 5/497 |
| 5,933,886 | A * | 8/1999 | Washington | 5/494 |
| 6,032,308 | A * | 3/2000 | Chuang | 5/502 |
| 6,243,896 | B1 * | 6/2001 | Osuna et al. | 5/502 |
| 6,446,284 | B1 * | 9/2002 | Yang | 5/502 |
| 6,637,054 | B2 * | 10/2003 | Chuang | 5/502 |
| 2004/0187210 | A1 * | 9/2004 | Hickman | 5/482 |

OTHER PUBLICATIONS

"Buttonhole Elastic," Newark Dress Maker Supply, Nov. 7, 2004, http://web.archive.org/web/20041107172128/http://www.newarkdress.com/e51.html.*

Threads, Threads Magazine; "Beyond the Pattern: Great Sewing Techniques for Clothing"; 1995; Taunton Press.*

Press, Melanie; "Fabric Magic"; 1999; Frances Lincoln ltd.*

Creative Publishing International, Editors of Creative Publishing; "Sewing 101: A Beginner's Guide to Sewing"; 2003; Creative Publishing Int'l.*

Jeffreys, Chris; "More Sew-It-Yourself Home Decor: Over 50 Easy-to-Make Designs for Beds, Chairs, Tables, and Windows"; 2005; KP Craft.*

* cited by examiner

*Primary Examiner* — Carlos Lugo
*Assistant Examiner* — Alyson M Merlino
(74) *Attorney, Agent, or Firm* — Raymond Y. Chan; David and Raymond Patent Firm

(57) ABSTRACT

A comforter set includes a comforter piece having a peripheral edge, a comforter bag, and a fastening arrangement. The comforter bag has two cover layers overlapping to form a receiving cavity and an attachment edge. The fastening arrangement includes a plurality of first fasteners spacedly provided along an outer side of the peripheral edge of the comforter piece, and a plurality of second fasteners spacedly provided along an inner side of the attachment edge, wherein the second fasteners are detachably fastened with the first fasteners respectively to fittingly retain the comforter piece in the receiving cavity of the comforter bag at a position that the attachment edge is alignedly covered on the peripheral edge in an edge-to-edge manner to substantially pull the peripheral edge close to the attachment edge.

18 Claims, 10 Drawing Sheets

COMFORTER SET

BACKGROUND OF THE PRESENT INVENTION

1. Field of Invention

The present invention relates to a comforter, and more particularly to a comforter set comprising a comforter bag and a comforter piece which is arranged to securely retain in the comforter bag in an edge-to-edge manner so as to minimize lateral movement between the comforter piece and the comforter bag.

2. Description of Related Arts

A conventional comforter set comprises a comforter bag and a comforter piece which is arranged to receive into the comforter bag. In order to retain the position of the comforter piece within the comforter bag, the conventional comforter set usually further comprises a fastening arrangement comprising a plurality of first and second fasteners provided in the comforter bag and the comforter piece respectively, wherein each of the first and second fasteners are positioned corresponding with each other so that each of the first fasteners is adapted to fasten to the corresponding second fastener.

As a matter of conventional arts, the first and the second fasteners are usually embodied as buttons and fastening loops. When the comforter piece is inserted into the comforter bag, a user may manually fasten the buttons with the fastening loops respectively so as to retain the comforter piece in position within the comforter bag. The fastening loops are usually inwardly, integrally and spacedly extended from the side edges of the comforter bag to fasten with the corresponding buttons.

A major disadvantage of this type of conventional comforter is that the first fasteners and the second fasteners usually fail to achieve a satisfactorily retention of position on the part of the comforter piece within the comforter bag. In particular, the comforter piece is loosely retained in the comforter bag so that when the comforter set is used in cold whether, the edge of the comforter bag which is close to the user's neck may not be filled by the comforter piece. The consequence is that the user's neck portion may not have enough coverage by the comforter piece and therefore insulation from the cold weather.

To state the problem more generally, there exists a significant gap between an edge of the comforter bag and the corresponding edge of the comforter piece. As a result, when the comforter set is being used for a prolonged period of time, the loose fastening between the comforter bag and the comforter piece often makes the comforter piece to deform within the comforter bag so as to adversely affect uniform insulation of the comforter piece within the area cover by the comforter bag.

SUMMARY OF THE PRESENT INVENTION

A main object of the present invention is to provide a comforter set comprising a comforter bag and a comforter piece which is arranged to securely retain in the comforter bag so as to minimize lateral movement between the comforter piece and the comforter bag.

Another object of the present invention is to provide a comforter set which comprises a fastening arrangement for fastening the comforter bag with the comforter piece in an edge-to-edge manner so as to prevent substantial collateral movement between the comforter bag and the comforter piece. In other words, the comforter piece is ensured to have substantially entire coverage within the area of the comforter bag.

Another object of the present invention is to provide a comforter set which comprises a comforter bag having four retention channels formed along four attachment edges thereof respectively for fastening with four peripheral edges of the comforter piece in an edge-to-edge manner within the retention channels so as to ensure minimal gap between the peripheral edge of the comforter piece and a corresponding attachment edge of the comforter bag.

Another object of the present invention is to provide a comforter set comprising a comforter piece which has a uniform thickness at the peripheral edge thereof, so as to allow easy fastening of the comforter piece with the comforter bag without loosening of the comforter piece in the comforter bag.

Accordingly, in order to accomplish the above objects, the present invention provides a comforter set, comprising:

a comforter piece having a top surface, a bottom surface and a surrounding peripheral edge;

a comforter bag having two cover layers overlapping to form a receiving cavity and an attachment edge; and a fastening arrangement, comprising:

a plurality of first fasteners spacedly provided along an outer side of the peripheral edge of the comforter piece; and a plurality of second fasteners spacedly provided along an inner side of the attachment edge, wherein the second fasteners are detachably fastened with the first fasteners respectively to fittingly retain the comforter piece in the receiving cavity of the comforter bag at a position that the attachment edge is alignedly covered on the peripheral edge in an edge-to-edge manner to substantially pull the peripheral edge close to the attachment edge so as to minimize a gap between the peripheral edge of the comforter piece and the attachment edge of the comforter bag.

These and other objectives, features, and advantages of the present invention will become apparent from the following detailed description, the accompanying drawings, and the appended claims.

DETAILED DESCRIPTION OF THE PREFERRED EMBODIMENT

Figure 1:
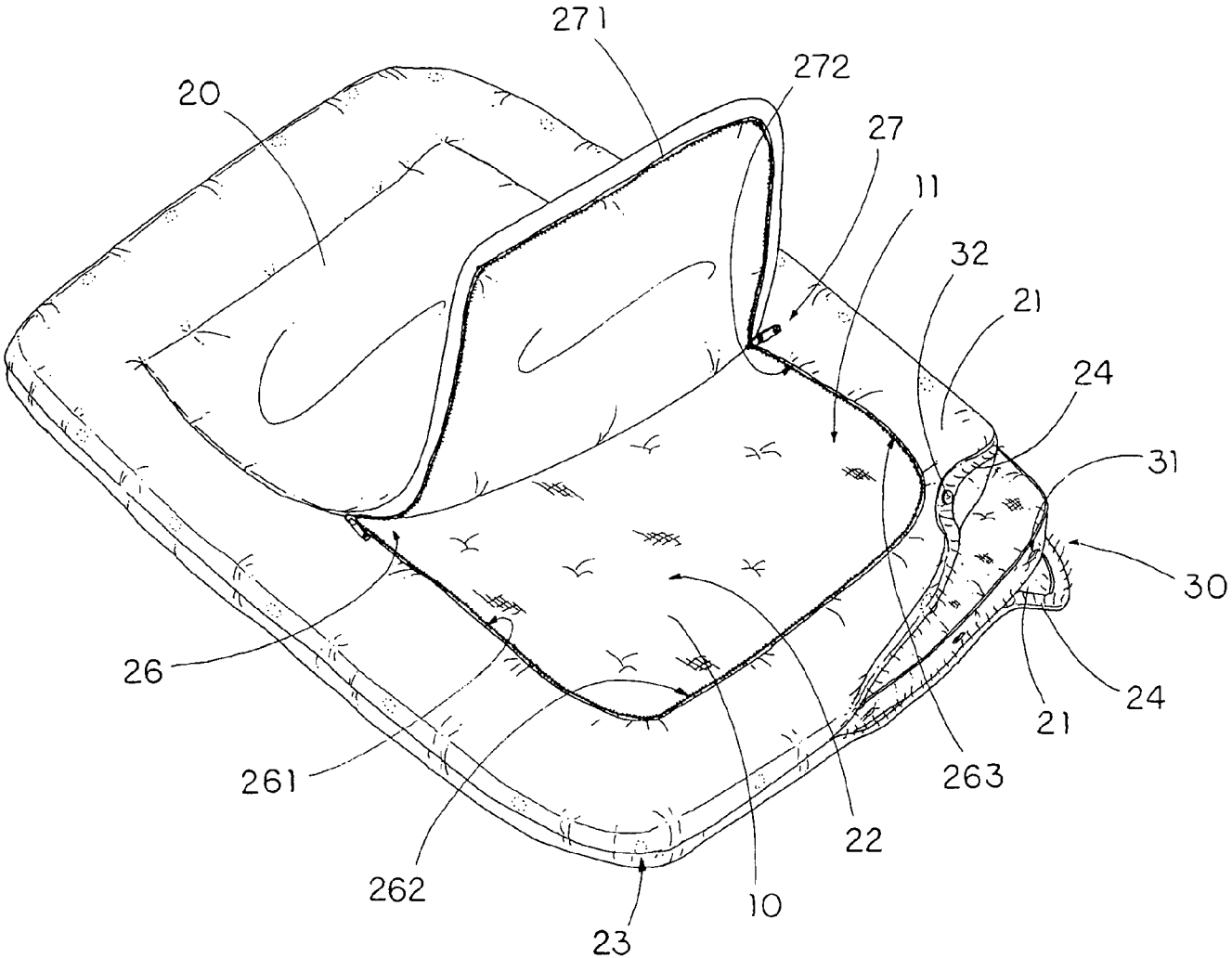
FIG. 1 is a perspective view of a comforter set according to a preferred embodiment of the present invention.
Figure 2A:
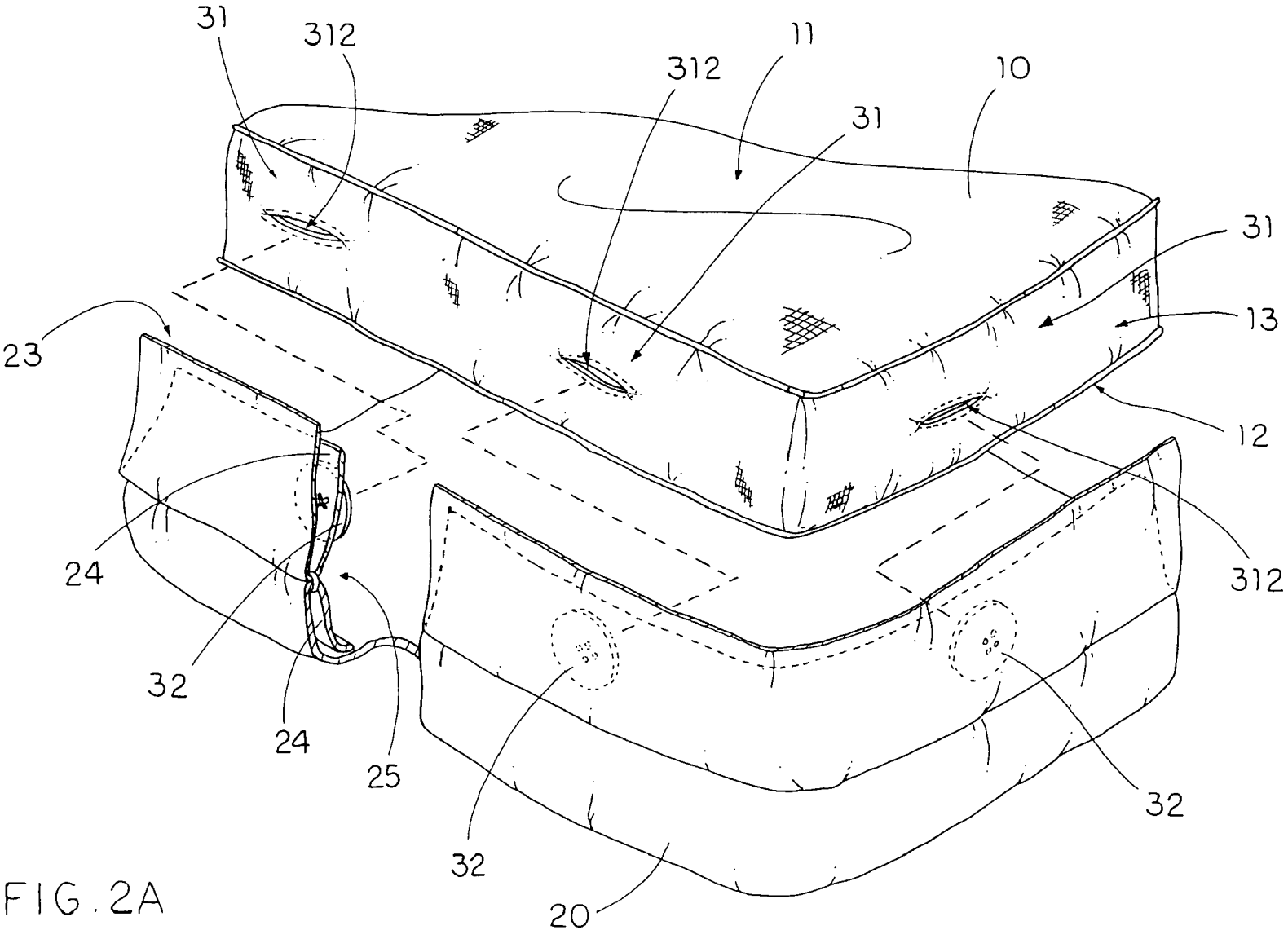
FIG. 2A and FIG. 2B are exploded perspective view and sectional side view of a comforter set according to the above preferred embodiment of the present invention.
Figure 2B:
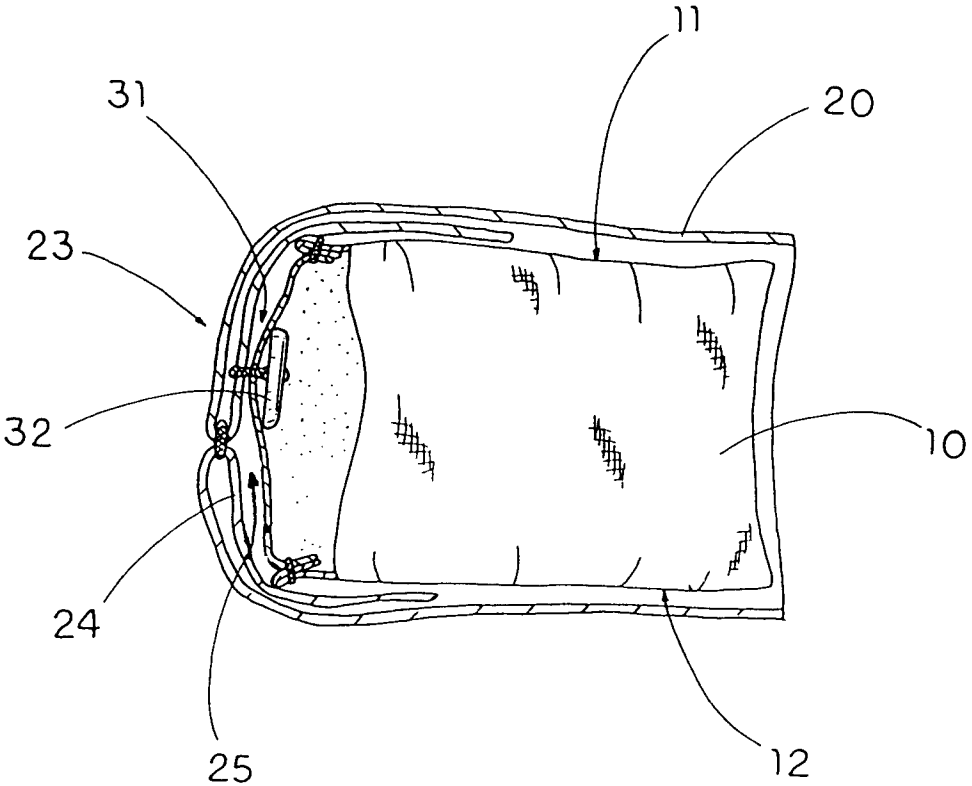

Referring to FIG. 1, FIG. 2A and FIG. 2B of the drawings, a comforter set according to a preferred embodiment of the present invention is illustrated, in which the comforter set comprises a comforter piece 10, a comforter bag 20, and a fastening arrangement 30. The comforter piece 10 has a top surface 11, a bottom surface 12 and a surrounding peripheral edge 13.

The comforter bag 20 has two cover layers 21 overlapping to form a receiving cavity 22 and an attachment edge 23.

The fastening arrangement 30 comprises a plurality of first fasteners 31 and a plurality of second fasteners 32. The first fasteners 31 are spacedly provided along an outer side of the peripheral edge 13 of the comforter piece 10.

The second fasteners 32 are spacedly provided along an inner side of the attachment edge 23, wherein the second fasteners 32 are detachably fastened with the first fasteners 31 respectively to fittingly retain the comforter piece 10 in the receiving cavity 22 of the comforter bag 20 at a position that the attachment edge 23 is alignedly covered on the peripheral edge 13 in an edge-to-edge manner to substantially pull the peripheral edge 13 close to the attachment edge 23 so as to minimize a gap between the peripheral edge 13 of the comforter piece 10 and the attachment edge 23 of the comforter bag 20.

According to the preferred embodiment of the present invention, the comforter piece 10, which is preferably embodied as having a rectangular cross section, is meant to possess a predetermined thickness so that it can be securely fastened with the comforter bag 20 in the above-mentioned edge-to-edge manner. Consequently, the surrounding peripheral edge 13 has a predetermined height for creating the predetermined thickness of the comforter piece 10. Moreover, the comforter piece 10 is preferably filled with insulating materials therewithin for minimizing heat loss from the area covered by the comforter piece 10.

The two cover layers 21 have two edge portions inwardly folded to overlappedly stitched with each other to form two attaching sleeves 24 and a retention channel 25 defined between the two attaching sleeves 24 at the attachment edge 23 of the comforter bag 20 and is communicated with the receiving cavity 22. In other words, each of the two attaching sleeves 24 is inwardly extended at the receiving cavity 22 for fastening with the corresponding peripheral edge 13 of the comforter piece 10.

In other words, the second fasteners 32 are spacedly provided along one of the attaching sleeves 24 within the retention channel 25 to detachably fasten with the first fasteners 31 respectively, such that the peripheral edge 13 of the comforter piece 10 is retained in the retention channel 25 to ensure the peripheral edge 13 of the comforter piece 10 positioning close enough to the attachment edge 23 of the comforter bag 20.

Each of the first fasteners 31 has an attachment loop 312 spacedly and directly provided along the peripheral edge 13 of the comforter piece 10, whereas each of the second fasteners 32 comprises an attachment button speacedly provided along the attachment edge 23 of the comforter bag 20 at a position corresponding with one of the first fasteners 31 so that the attachment button is adapted to insert through the attachment loop 312 for fastening the comforter bag 20 and the comforter piece 10 together, in such a manner that the comforter piece 10 is overlapped between the cover layers 21 of the comforter bag 20 at a position that the peripheral edge 13 of the comforter piece 10 is strictly aligned along the attachment edge 23 of the comforter bag 20.

More specifically, each of the attachment buttons are spacedly affixed on the attachment sleeves 24. The peripheral edges 13 of the comforter piece 10 is inserted into the retention channel 25 wherein the attachment button is fastened with the corresponding attachment loop 312 so as to retain the peripheral edge 13 of the comforter piece 10 into the retention channel 25 of the comforter bag 20. The consequence is that the comforter piece 10 is pulled to fasten with the attachment edge 23 of the comforter bag 20 so as to minimize the gap between the peripheral edge 13 and the attachment edge 23.

The comforter bag 20 further comprises an inlet access 26 provided thereon, and at least one zipper unit 27 provided at the inlet access 26 for selectively zipping the inlet access 26 so as to allow the comforter piece 10 to be disposed in the receiving cavity 22 via the inlet access 26 when the zipper unit 27 is unzipped.

Thus, the zipper unit 27 is provided along an edge of the inlet access 26 to selectively open and close the receiving cavity 22 for the comforter piece 10 receiving in and removing from the receiving cavity 22 of the comforter bag 20 respectively.

According to the preferred embodiment of the present invention, the inlet access 26 is an U-shape opening defining a first side edge 261, a second side edge 262, and a third side edge 263 extending along the attachment edge 23, wherein the zipper unit 27 comprises a first and a second zipping member 271, 272 affixed along the first through third side edges 261. 262, 263, and adapted for zipping with each other so as to selectively open and close the inlet access 26. Alternatively, the inlet access 26 may be embodied as forming an L-shape opening or even as a single elongated opening for allowing the comforter piece 10 to be disposed into the receiving cavity 22 of the comforter bag 20.

In other words, the inlet access 26 is an opening forming on at least two corresponding side edge portions of the respective cover layer 21 to allow the receiving cavity 22 to be accessed, wherein the zipper unit 27 comprises the first and second zipping members 271, 272 affixed along the edges of the inlet access 26 so as to selectively open and close the receiving cavity 22.

It is worth mentioning that the first and the second fasteners 31, 32 can be embodied as a wide variety of fasteners. For example, the first and the second fasteners 31, 32 can be embodied as buttons and loop connectors, hook fasteners and loop fasteners, or any other conventional attaching devices or connectors.

The operation of the present invention is as follows: when the user wishes to put the comforter piece 10 into the comforter bag 20, he or she may first unzip the zipper unit 27, and then put the comforter piece 10 into the comforter bag 20. After that, the user needs to insert the peripheral edge 13 into the retention channel 25 and then fasten the first fasteners 31 with the second fasteners 32. When all the first fasteners 31 have been fastened with the second fasteners 32, the user can then zip the zipper unit 27 again and the comforter set is ready for his or her use.

Figure 3A:
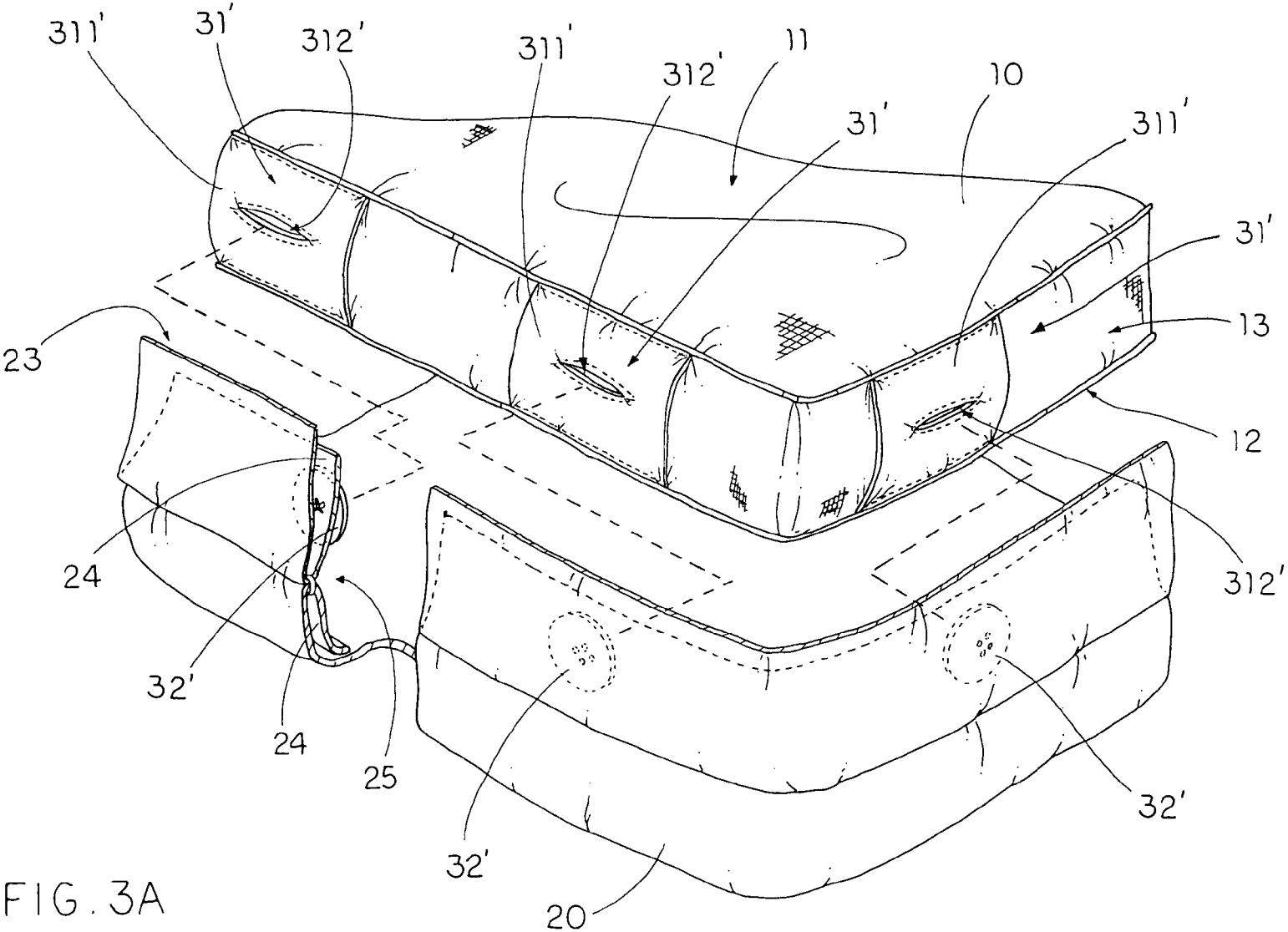
FIG. 3A and FIG. 3B are illustration of a first alternative mode of the comforter set according to the above preferred embodiment of the present invention.
Figure 3B:
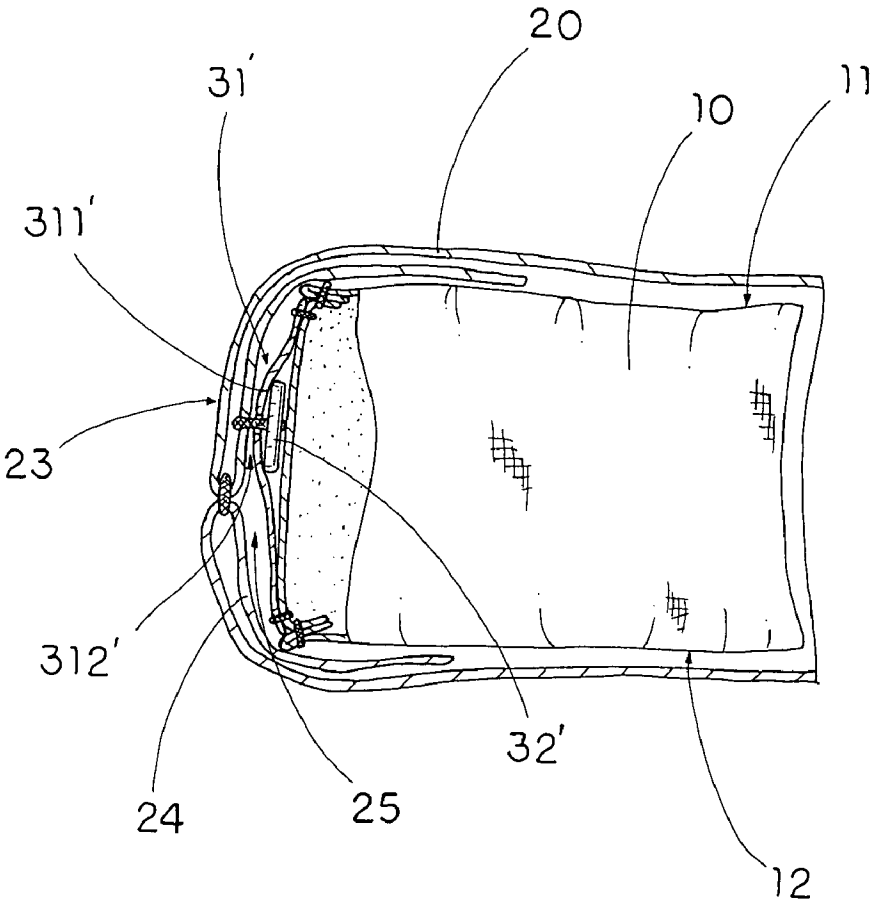

Referring to FIG. 3A and FIG. 3B of the drawings, a first alternative mode of the comforter set according to the preferred embodiment of the present invention is illustrated. The first alternative mode is similar to the preferred embodiment except the first fasteners 31' and second fasteners 32'. According to the first alternative mode, each of the first fasteners 31' comprises a pocket layers 311' having two ends securely stitched on an upper end and a lower end of the peripheral edge 13 of the comforter piece 10, and a through attachment loop 312' formed on the pocket layer 311' for the corresponding second fastener 32' to be inserted therethrough so as to fasten the comforter piece 10 with the comforter bag 20.

More specifically, the pocket layer 311' and the peripheral edge 13 of the comforter piece 10 form an attachment cavity, wherein the relevant second fastener 32' is capable of detachably inserting through the attachment loop 312' and interlocking with an inner side of the pocket layer 311' in the attachment cavity so as to fasten the first fastener 31' with the corresponding second fastener 32'.

Figure 4A:
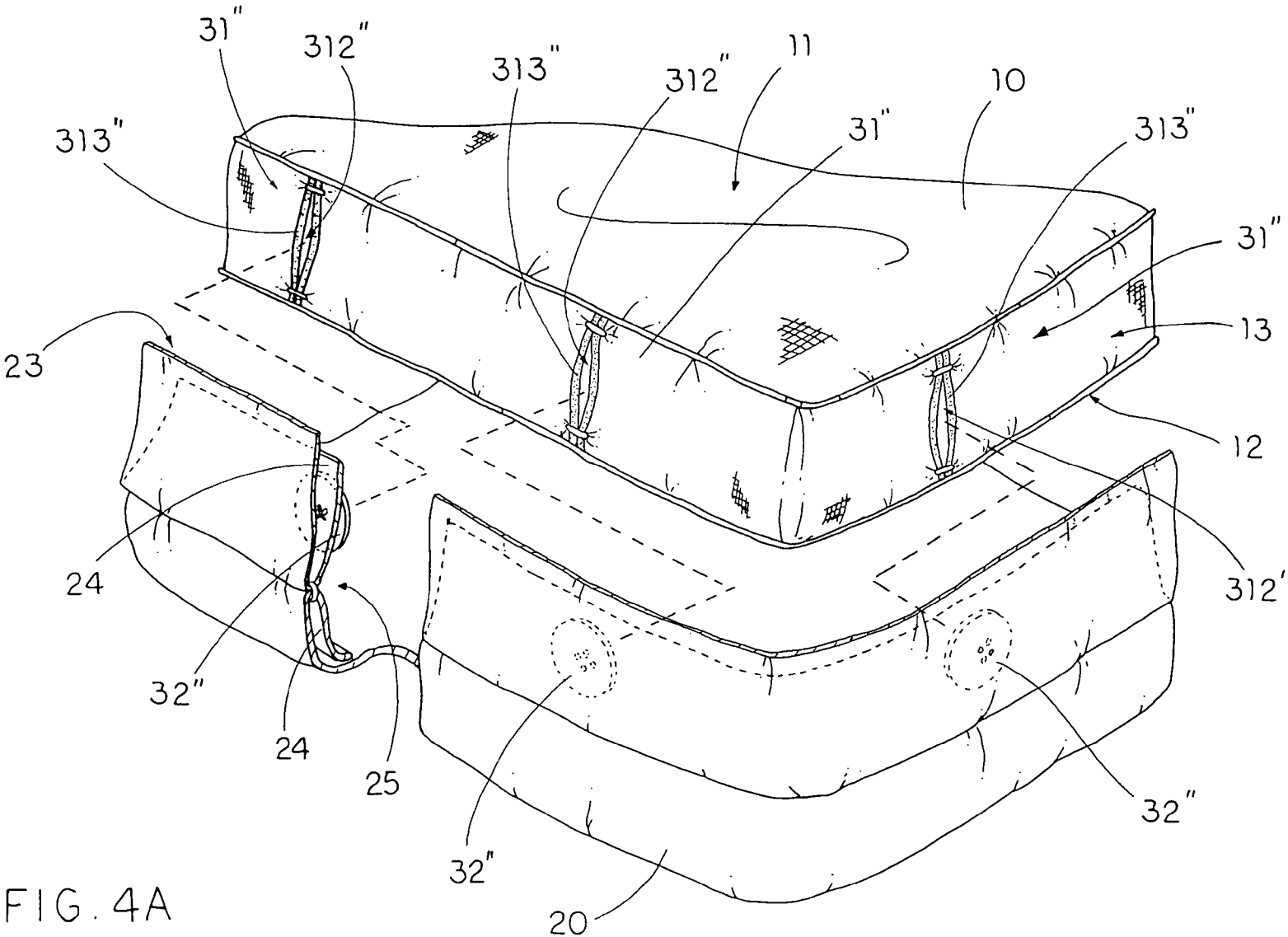
FIG. 4A and FIG. 4B are illustration of a second alternative mode of the comforter set according to the above preferred embodiment of the present invention.
Figure 4B:
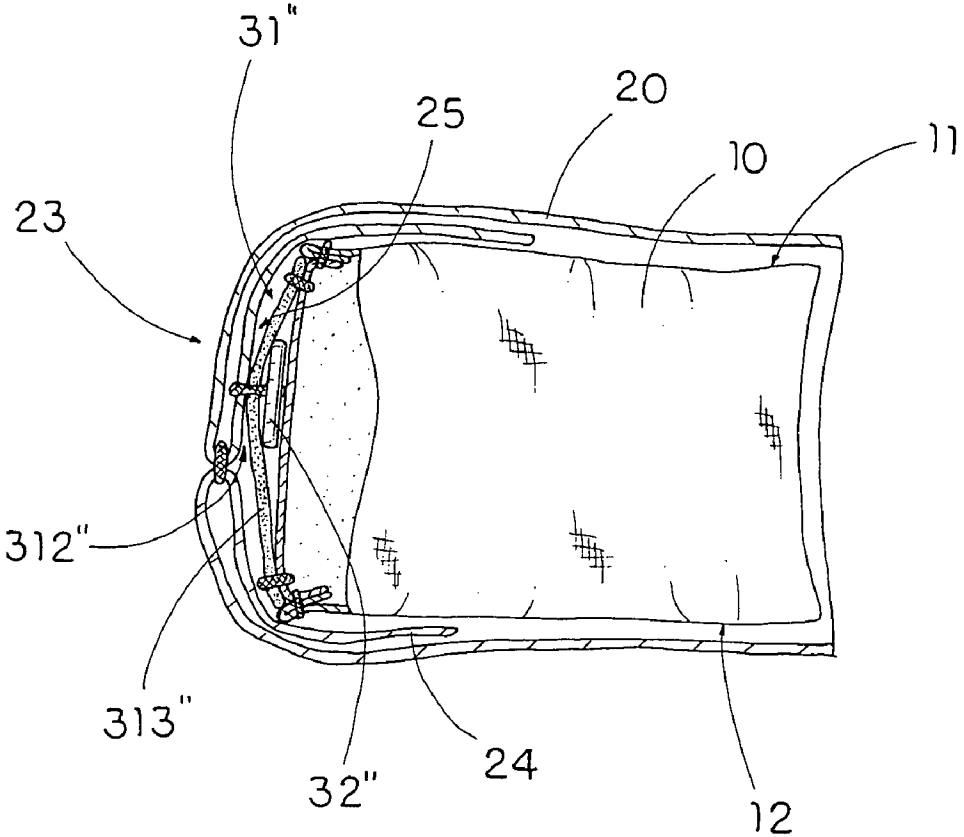

Referring to FIG. 4A and FIG. 4B of the drawings, a second alternative mode of the comforter set according to the preferred embodiment of the present invention is illustrated. The second alternative mode is similar to the preferred embodiment except the first fasteners 31" and second fasteners 32".

According to the second alternative mode, the comforter piece 10 further comprises, instead of the pocket layers 311', a plurality of elastic holders 313" spacedly affixed along the peripheral edge 13 of the comforter piece 10, wherein each of the elastic holders 313" comprises two elastic straps forming the attachment loop 312" therebetween to fasten with the corresponding attachment button so as to apply an elastic pulling force to pull the peripheral edge 13 of the comforter piece 10 close enough to the attachment edge of the comforter bag 20. It is worth mentioning that the pocket layers 311' and the elastic holders 313" may both be formed on the peripheral edge 13.

Figure 5:
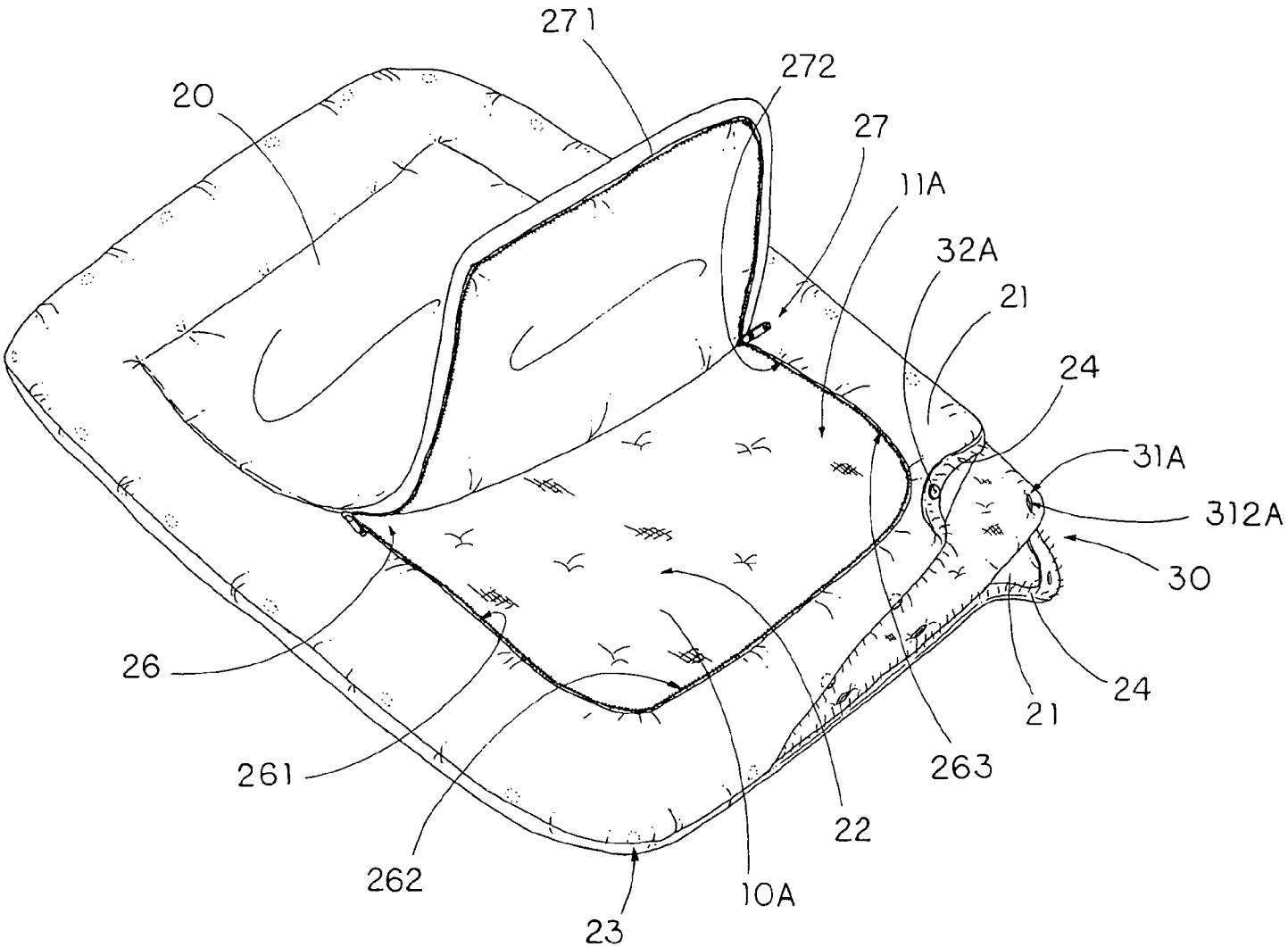
FIG. 5 is an illustration of a third alternative mode of the comforter set according to the above preferred embodiment of the present invention.
Figure 6:
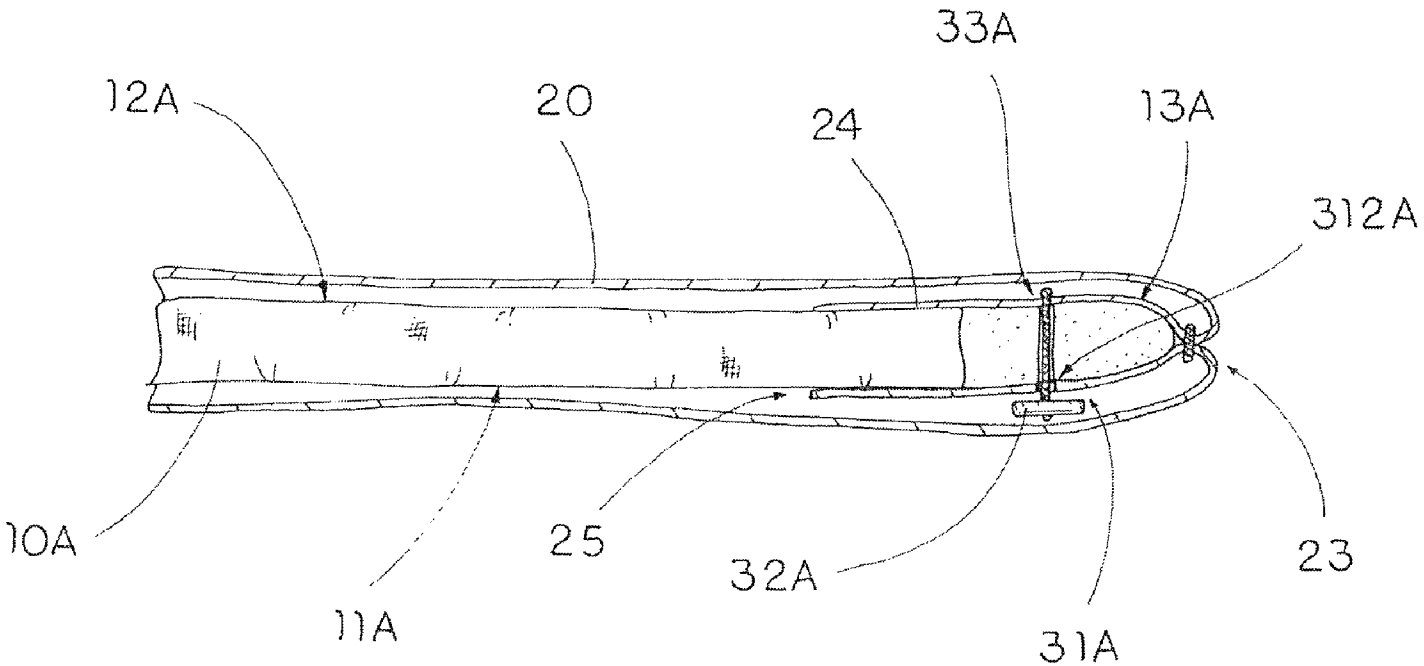
FIG. 6 is a sectional side view of the third alternative mode of the comforter set according to the above preferred embodiment of the present invention.

Referring to FIG. 5 to FIG. 6 of the drawings, a third alternative mode of the comforter set according to the preferred embodiment of the present invention is illustrated. The second alternative mode is similar to the preferred embodiment except the first fasteners 31A, second fasteners 32A and the comforter piece 10A. According to the third alternative mode, the peripheral edge 13A of the comforter piece 10A is reduced to nominal height such that the top surface 11A is arrange to overlap on top of the bottom surface 12A. The peripheral edge 13A of the comforter piece 10A is then inserted into the retention channel 25 for fastening with the comforter bag 20.

Moreover, the first fasteners 31A are provided on the top surface 11A of the comforter piece 10A in such a manner that when the peripheral edge 13A of the comforter piece 10A is inserted into the retention channel 25, the first fasteners 31A are adapted to fasten with the second fasteners 32A respectively for fastening the comforter piece 10A with the comforter bag 20 in the above-mentioned edge-to-edge manner.

Moreover, the fastening arrangement 30 further has a plurality of retention loops 33A spacedly formed along another the attaching sleeve 24 within the retention channel 25 to align with the attachment buttons respectively such that the attachment buttons are fastened with the retention loops 33A through the attachment loops 312A respectively to sandwich the peripheral edge 13A of the comforter piece 10A between the attaching sleeves 24 so as to substantially retain the peripheral edge 13A of the comforter piece 10A along the attachment edge 23 of the comforter bag 20.

Figure 7:
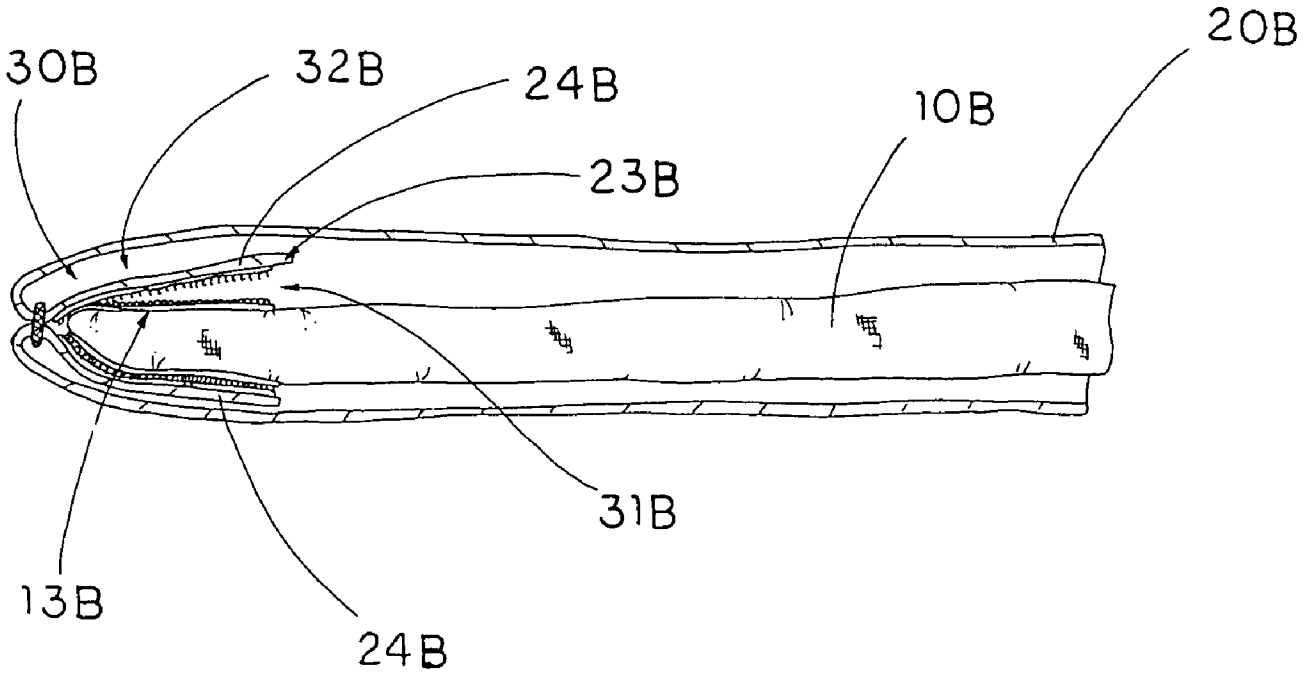
FIG. 7 is a sectional side view of a fourth alternative mode of the comforter set according to the above preferred embodiment of the present invention.

Referring to FIG. 7 of the drawings, a fourth alternative mode of the comforter set according to the preferred embodiment of the present invention is illustrated. The fourth alternative mode is similar to the preferred embodiment except the fastening arrangement 30B. According to the fourth alternative mode, each of the first and the second fasteners 31B, 32B is embodied as a hook and loop fasteners respectively for attaching the comforter piece 10B with the comforter bag 20B.

As a result, the second fastener 32B can be provided on the comforter set in such a manner that the loop fastener is formed on an inner side of the top attaching sleeve 24B (the attachment edge 23B) while the hook fastener is formed on the corresponding position on an outer side of the comforter piece 10B. Similarly, the first fastener 31B can be provided on the comforter set in such a manner that the loop fastener is formed on an inner side of the bottom attaching sleeve 24B while the hook fastener is formed on the corresponding position on an outer side of the comforter piece 10B (the peripheral edge 13B). With the hook and loop fasteners, the user is able to detachably attach the comforter piece 10B with the comforter bag 20B very easily.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A comforter set, comprising:

a comforter piece having a top surface, a bottom surface and a surrounding peripheral edge;

a comforter bag having two cover layers overlapping to form a receiving cavity and an attachment edge, wherein two edge portions of said two cover layers are inwardly folded to overlappedly stitch with each other to form two attaching sleeves respectively at said attachment edge and to form a retention channel between said two attaching sleeves at said attachment edge within said receiving cavity to receive said peripheral edge of said comforter piece in edge-to-edge manner at said retention channel; and a fastening arrangement, comprising:

a plurality of first fasteners spacedly provided along an outer side of said peripheral edge of said comforter piece; and a plurality of second fasteners spacedly provided along one of said attaching sleeves within said retention channel, wherein said second fasteners are detachably fastened with said first fasteners respectively to fittingly retain said comforter piece in said receiving cavity of said comforter bag at a position that said attachment edge is alignedly covered on said peripheral edge in an edge-to-edge manner and said peripheral edge of said comforter piece is pulled alongside said attachment edge of said comforter bag to minimize a gap between said peripheral edge of said comforter piece and said attachment edge of said comforter bag, wherein said comforter piece completely fills said comforter bag such that said peripheral edge of said comforter piece is adjacent to said attachment edge of said comforter piece to avoid substantial collateral movement between said comforter bag and said comforter piece.

2. The comforter set, as recited in claim 1, wherein said first fasteners are a plurality of attachment loops and said second fasteners are a plurality of attachment buttons respectively in such a manner that when said attachment buttons are fastened with said attachment loops respectively, said comforter piece is overlapped between said cover layers of said comforter bag at a position that said peripheral edge of said comforter piece is strictly aligned along said attachment edge of said comforter bag.

3. The comforter set, as recited in claim 1, wherein said second fasteners are a plurality of attachment buttons spacedly provided along one of said attaching sleeves at said attachment edge and said first fasteners are a plurality of attachment loops spacedly provided along said peripheral edge of said comforter piece, wherein said fastening arrangement further has a plurality of retention loops spacedly formed along the other sleeve of said attaching sleeves within said retention channel at said attachment edge at a position that when said comforter piece is received in said comforter bag, said attachment loops are aligned with said retention loops, wherein said attachment buttons are fastened with said retention loops respectively by passing said attachment buttons through said attachment loops respectively such that said peripheral edge of said comforter piece is sandwiched between said two attaching sleeves at said attachment edge of said comforter bag so as to substantially retain said peripheral edge of said comforter piece along said attachment edge of said comforter bag.

4. The comforter set, as recited in claim 1, wherein said comforter bag further comprises an inlet access provided on one of said cover layers and at least a zipper unit provided along an edge of said inlet access to selectively open and close said receiving cavity for said comforter piece receiving in and removing from said receiving cavity of said comforter bag respectively.

5. The comforter set, as recited in claim 2, wherein said comforter bag further comprises an inlet access provided on one of said cover layers and at least a zipper unit provided along an edge of said inlet access to selectively open and close said receiving cavity for said comforter piece receiving in and removing from said receiving cavity of said comforter bag respectively.

6. The comforter set, as recited in claim 3, wherein said comforter bag further comprises an inlet access provided on one of said cover layers and at least a zipper unit provided along an edge of said inlet access to selectively open and close said receiving cavity for said comforter piece receiving in and removing from said receiving cavity of said comforter bag respectively.

7. The comforter set, as recited in claim 4, wherein said inlet access is an opening forming on at least two corresponding side edge portions of said respective cover layer to allow said receiving cavity to be accessed, wherein said zipper unit comprises a pair of first and second zipping members affixed along said edges of said inlet access so as to selectively open and close said receiving cavity.

8. The comforter set, as recited in claim 5, wherein said inlet access is an opening forming on at least two corresponding side edge portions of said respective cover layer to allow said receiving cavity to be accessed, wherein said zipper unit comprises a pair of first and second zipping members affixed along said edges of said inlet access so as to selectively open and close said receiving cavity.

9. The comforter set, as recited in claim 6, wherein said inlet access is an opening forming on at least two corresponding side edge portions of said respective cover layer to allow said receiving cavity to be accessed, wherein said zipper unit comprises a pair of first and second zipping members affixed along said edges of said inlet access so as to selectively open and close said receiving cavity.

10. The comforter set, as recited in claim 1, wherein each of said first and said second fasteners are hook and loop fasteners respectively, wherein each of said hook fasteners is provided along said peripheral edge of said comforter piece, and said loop fastener is provided at a corresponding position on a corresponding attaching sleeve of the two attaching sleeves for detachably attaching with said respective hook fastener.

11. A comforter set, comprising:

a three-dimensional comforter piece having a top surface, a bottom surface and a surrounding peripheral edge having a predetermined height equal to a distance between said top and bottom surface for creating a predetermined uniform thickness of said comforter piece;

a comforter bag having two cover layers overlapping to form a receiving cavity and an attachment edge, wherein two edge portions of said two cover layers are inwardly folded to overlappedly stitch with each other to form two attaching sleeves respectively at said attachment edge and to form a retention channel between said two attaching sleeves at said attachment edge within said receiving cavity to receive said peripheral edge of said comforter piece in edge-to-edge manner at said retention channel; and a fastening arrangement, comprising a plurality of first fasteners spacedly provided along an outer side of said peripheral edge of said comforter piece, and a plurality of second fasteners spacedly provided along an inner side of one of said attaching sleeves, wherein said second fasteners are detachably fastened with said first fasteners respectively to fittingly retain said comforter piece in said receiving cavity of said comforter bag at a position that said attachment edge is alignedly covered on said peripheral edge in an edge-to-edge manner to avoid substantial collateral movement between said comforter bag and said comforter piece.

12. The comforter set, as recited in claim 11, wherein said first fasteners are a plurality of attachment loops and said second fasteners are a plurality of attachment buttons respectively in such a manner that when said attachment buttons are fastened with said attachment loops respectively, said comforter piece is overlapped between said cover layers of said comforter bag at a position that said peripheral edge of said comforter piece is strictly aligned along said attachment edge of said comforter bag.

13. The comforter set, as recited in claim 12, wherein each of said attachment loops is directly formed on said peripheral edge of said comforter piece to fasten with said corresponding attachment button.

14. The comforter set, as recited in claim 12, wherein said comforter piece further comprises a plurality of pocket layers spacedly affixed along said peripheral edge of said comforter piece, wherein said attachment loops are respectively formed on said pocket layers to fasten with said corresponding attachment button so as to receive said attachment buttons in said pocket layers respectively.

15. The comforter set, as recited in claim 14, wherein said comforter piece further comprises a plurality of elastic holders spacedly affixed along said peripheral edge of said comforter piece, wherein each of said elastic holders comprises two elastic straps forming said attachment loop therebetween to fasten with said corresponding attachment button so as to apply an elastic pulling force to pull said peripheral edge of said comforter piece close enough to said attachment edge of said comforter bag.

16. The comforter set, as recited in claim 12, wherein said comforter bag further comprises an inlet access provided on one of said cover layers and at least a zipper unit provided along an edge of said inlet access to selectively open and close said receiving cavity for said comforter piece receiving in and removing from said receiving cavity of said comforter bag respectively.

17. The comforter set, as recited in claim 14, wherein said comforter bag further comprises an inlet access provided on one of said cover layers and at least a zipper unit provided along an edge of said inlet access to selectively open and close said receiving cavity for said comforter piece receiving in and removing from said receiving cavity of said comforter bag respectively.

18. The comforter set, as recited in claim 15, wherein said comforter bag further comprises an inlet access provided on one of said cover layers and at least a zipper unit provided along an edge of said inlet access to selectively open and close said receiving cavity for said comforter piece receiving in and removing from said receiving cavity of said comforter bag respectively.

* * * * *